US005971563A

United States Patent [19]

Maggio

[11] Patent Number: 5,971,563

[45] Date of Patent: Oct. 26, 1999

[54] FLEXIBLE MESHED DECORATIVE LIGHT STRING SET FOR CONE-, RECTANGULAR-, AND DOME-SHAPED, TREES, BUSHES, AND LIKE OBJECTS

[76] Inventor: Damian Maggio, 1458 Holiday Park Dr., Wantagh, N.Y. 11793

[21] Appl. No.: 08/779,227

[22] Filed: Jan. 6, 1997

[51] Int. Cl.[6] ..... F21V 21/00

[52] U.S. Cl. ..... 362/249; 362/123; 362/122; 362/252; 362/807; 362/808

[58] Field of Search ..... 362/123, 122, 362/252, 249, 807, 808

[56] References Cited

U.S. PATENT DOCUMENTS

| | | | |
|---|---|---|---|
| 2,495,639 | 1/1950 | Moreno | 362/249 |
| 3,770,951 | 11/1973 | Corelli | 362/123 |
| 4,736,282 | 4/1988 | Ahroni | 362/123 |
| 5,424,925 | 6/1995 | Jenke et al. | 362/123 |
| 5,531,411 | 7/1996 | Adams | 362/123 |
| 5,601,361 | 2/1997 | Lawrence | 362/238 |
| 5,624,181 | 4/1997 | Miller et al. | 362/252 |
| 5,629,057 | 5/1997 | Wang et al. | 362/122 |
| 5,645,342 | 7/1997 | Chang | 362/252 |
| 5,662,409 | 9/1997 | Huang | 362/249 |
| 5,667,295 | 9/1997 | Tsui | 362/252 |
| 5,669,707 | 9/1997 | Huang | 362/249 |
| 5,716,124 | 2/1998 | Hsu | 362/252 |

*Primary Examiner*—Sandra O'Shea
*Assistant Examiner*—Ronald E. DelGizzi
*Attorney, Agent, or Firm*—Michael I. Kroll

[57] ABSTRACT

A holiday helper lighting system (12) comprising a support frame (14). A plurality of illuminating units (16) are carried on the support frame (14) in spaced apart relationships. An assembly (18) integral with the support frame (14), is for carrying an electrical current to the illuminating units (16), so that the illuminating units (16) will provide light therefrom.

4 Claims, 8 Drawing Sheets

Fig. 6
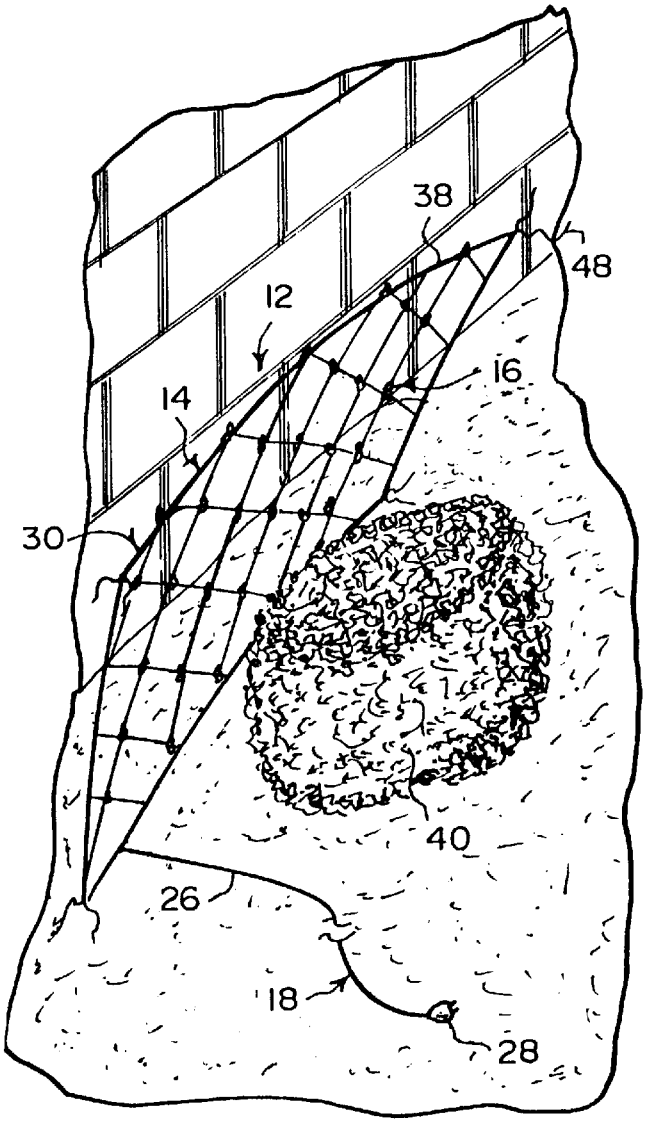
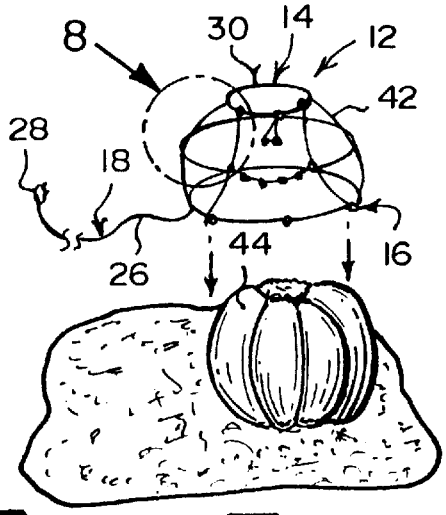
Fig. 7

FLEXIBLE MESHED DECORATIVE LIGHT STRING SET FOR CONE-, RECTANGULAR-, AND DOME-SHAPED, TREES, BUSHES, AND LIKE OBJECTS

BACKGROUND OF THE INVENTION

Field of the Invention

The instant invention relates generally to Christmas lights and decorations and more specifically it relates to a holiday helper lighting system.

Description of the Prior Art

Numerous Christmas lights and decorations have been provided in prior art that are adapted to include traditional string lights which when hung upon bushes, trees and buildings can take a long time to accomplish with lots of hard work. While these units may be suitable for the particular purpose to which they address, they would not be as suitable for the purposes of the present invention as heretofore described.

SUMMARY OF THE INVENTION

A primary object of the present invention is to provide a holiday helper lighting system that will overcome the shortcomings of the prior art devices.

Another object is to provide a holiday helper lighting system that is a configuration of lights that can be quickly attached to bushes, trees and buildings with little effort.

An additional object is to provide a holiday helper lighting system in which one form is a net type having evenly spaced lights, which can be placed over various shaped objects in a safe manner.

A further object is to provide a holiday helper lighting system that is simple and easy to use.

A still further object is to provide a holiday helper lighting system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 1:
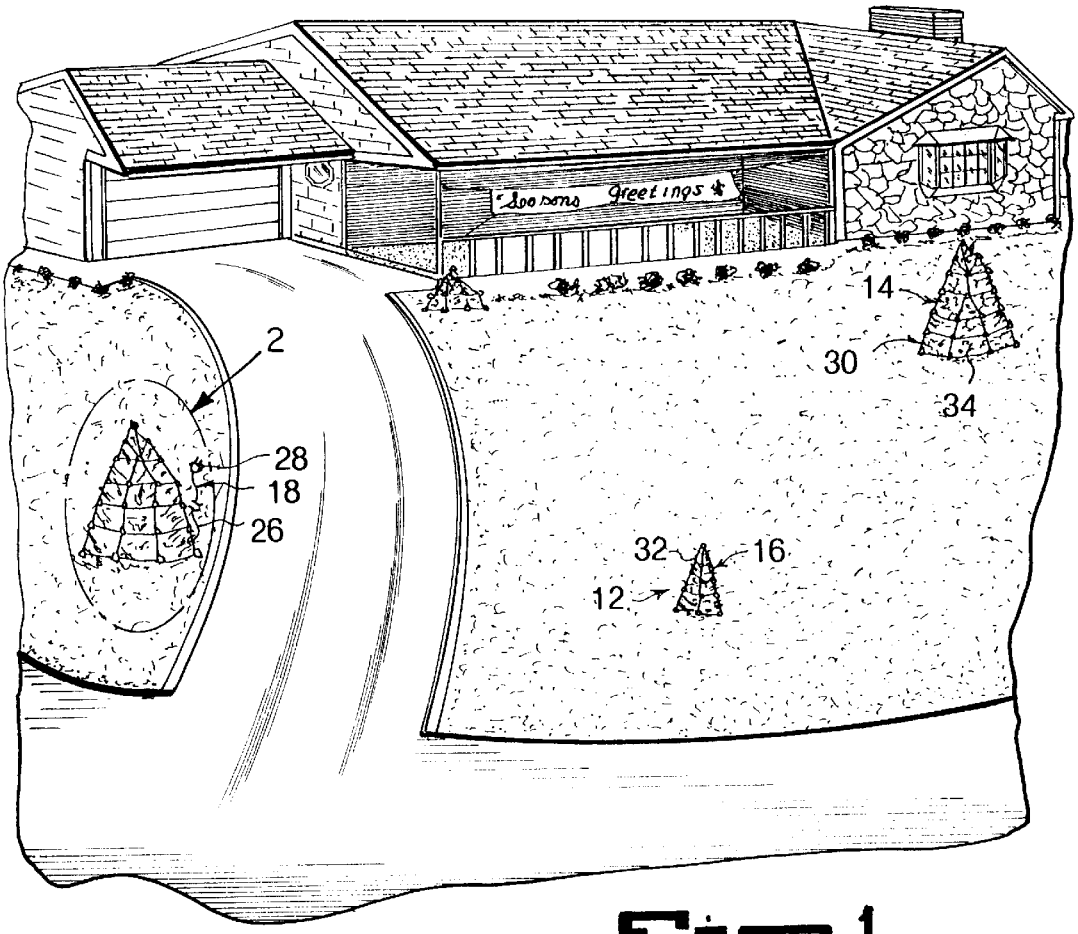
FIG. 1 is a perspective view showing a first embodiment of the instant invention installed on a plurality of trees on a lawn of a house.
Figure 2:
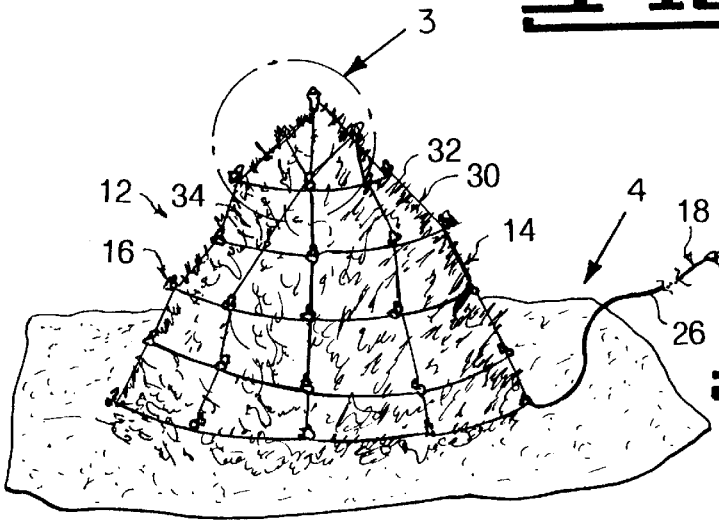
FIG. 2 is an enlarged perspective view as indicated by arrow 2 in FIG. 1, showing the first embodiment installed on one tree.
Figure 2A:
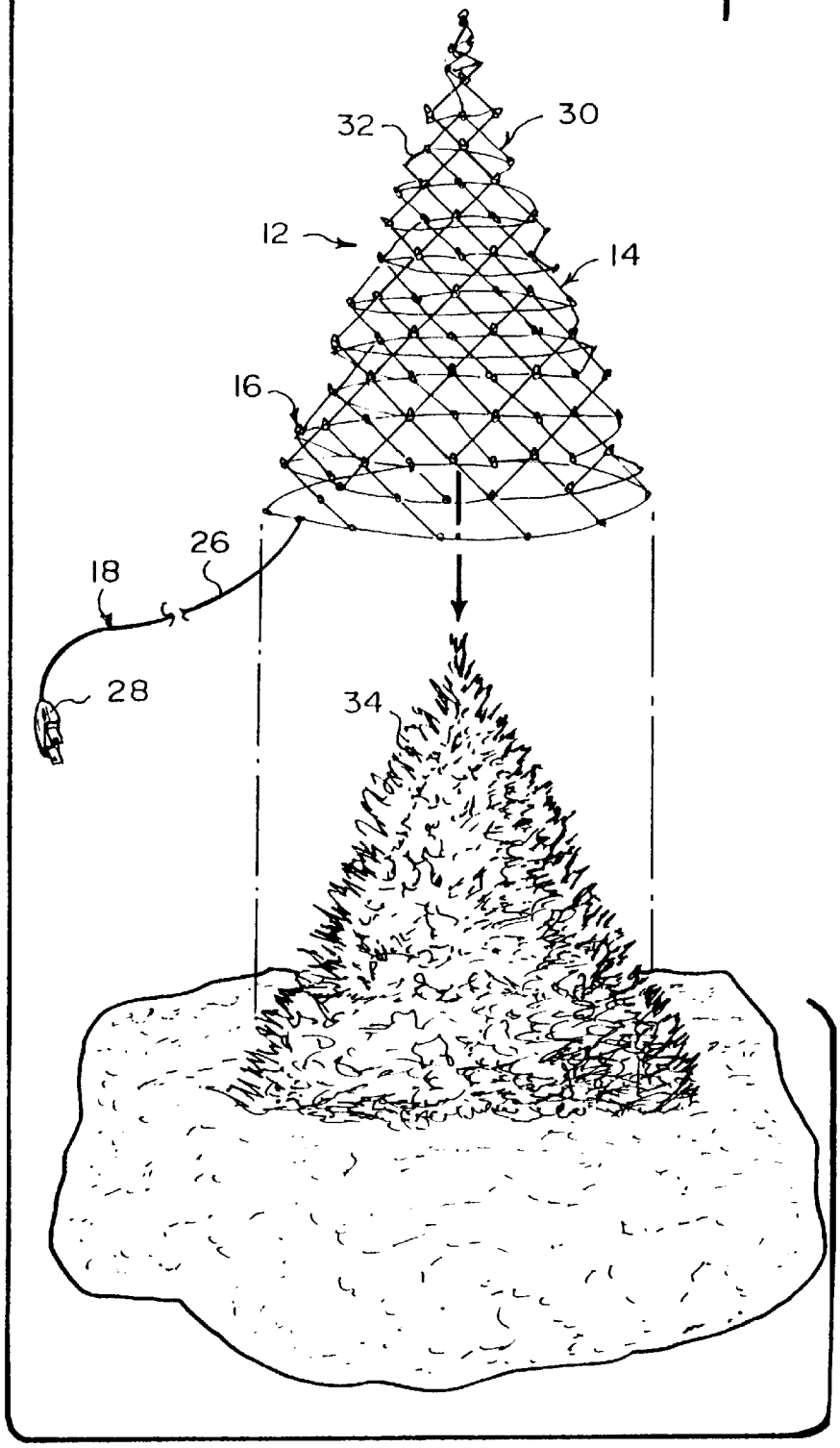

FIG. 2*a* is an exploded perspective view similar to FIG. 2, showing the first embodiment ready to be installed on the tree.

Figure 3:
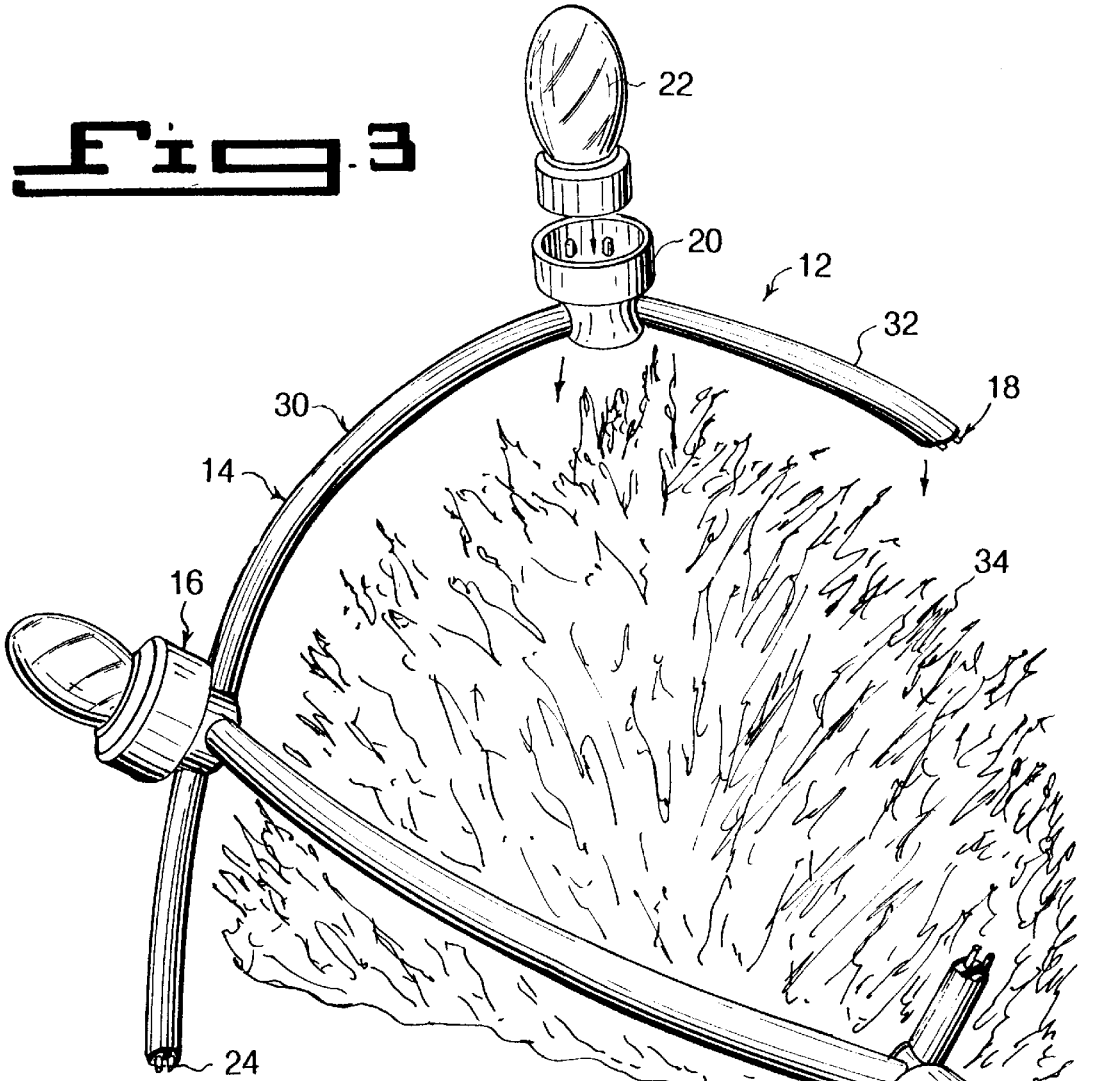

FIG. 3 is a further enlarged perspective view as indicated by arrow 3 in FIG. 2, of a portion of the first embodiment showing various components thereof in greater detail.

Figure 4:
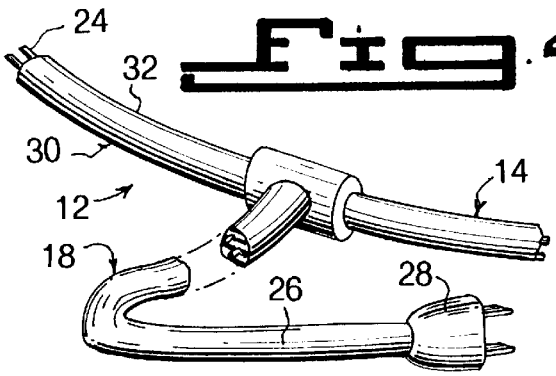

FIG. 4 is a further enlarged perspective view as indicated by arrow 4 in FIG. 2, showing the power cord and plug in greater detail.

Figure 5:
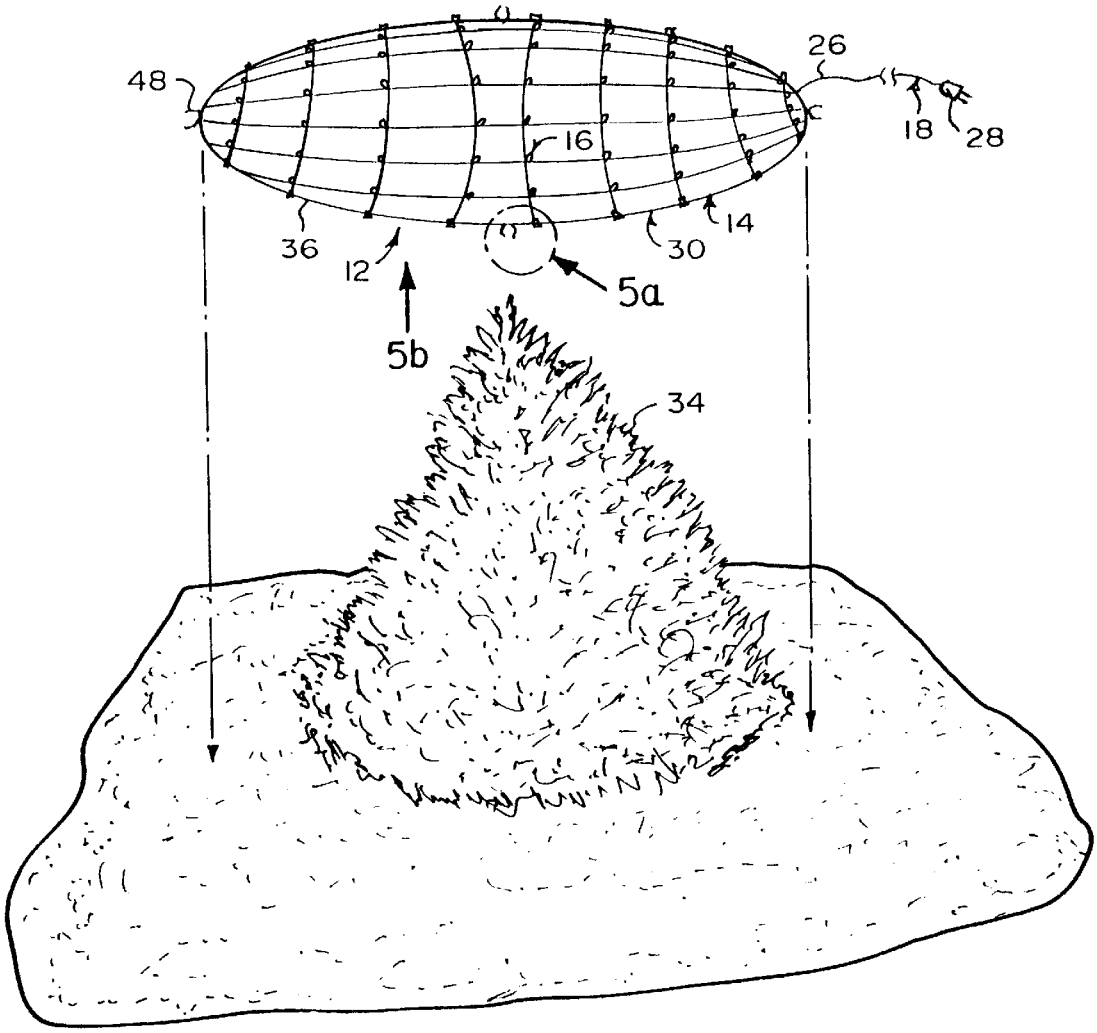

FIG. 5 is an exploded perspective view, showing a second embodiment of the instant invention ready to be installed on a tree.

Figure 5A:
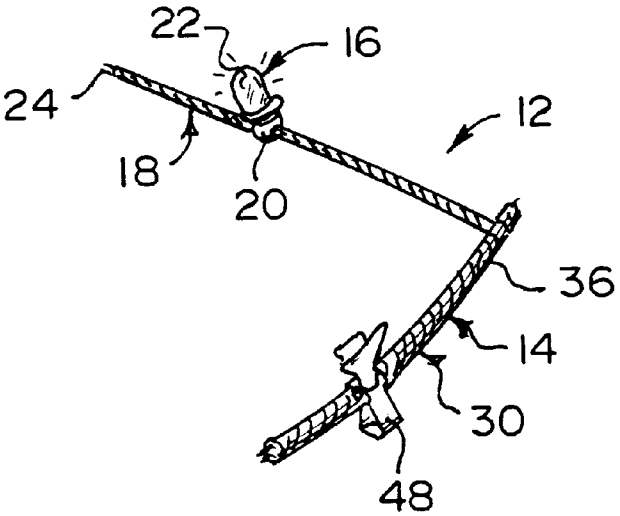

FIG. 5*a* is an enlarged perspective view as indicated by arrow 5*a* in FIG. 5, of a portion of the second embodiment showing various components thereof in great detail.

Figure 5B:
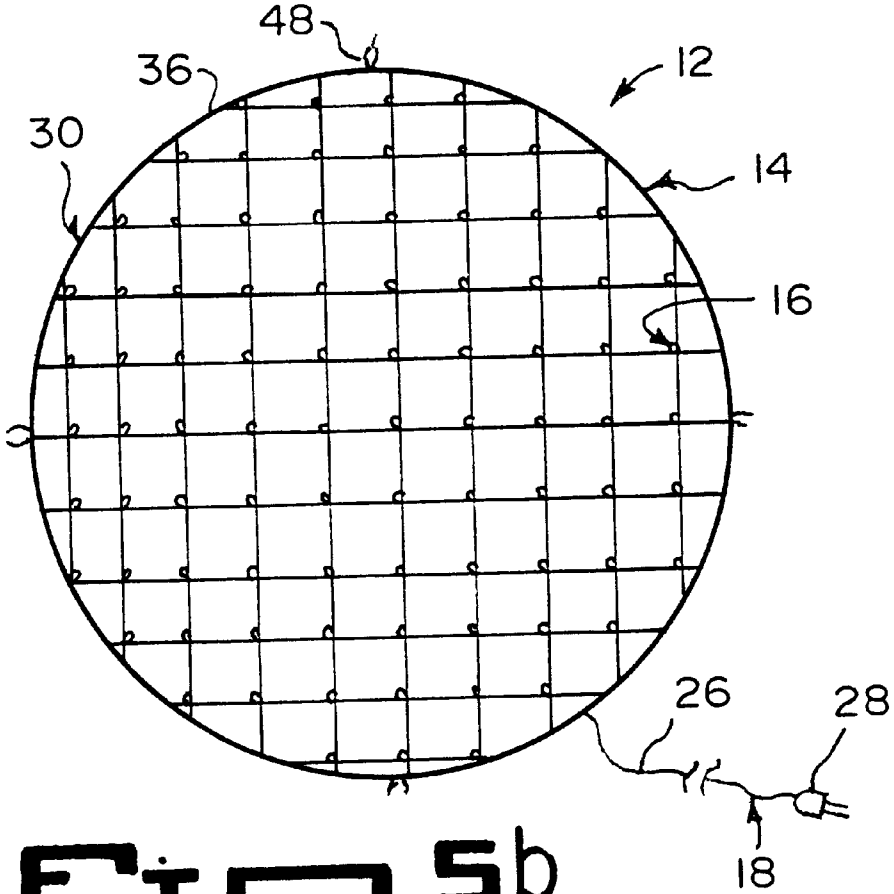

FIG. 5*b* is a bottom view of the second embodiment taken in the direction of arrow 5*b* in FIG. 5.

FIG. 6 is a perspective view of a third embodiment of the instant invention ready to be installed on a bush.

FIG. 7 is an exploded perspective view of a fourth embodiment of the instant invention ready to be installed on a pumpkin.

Figure 8:
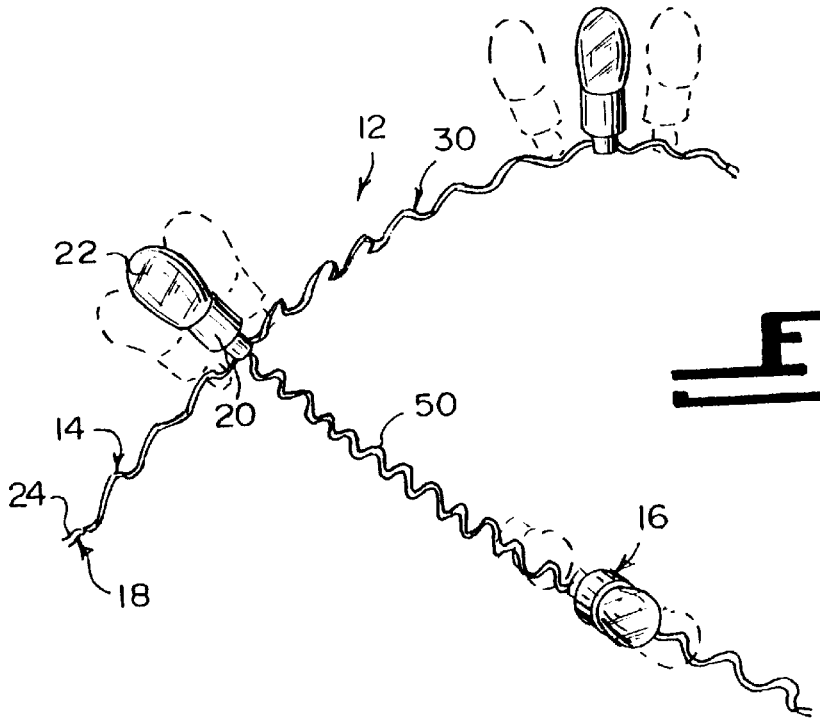

FIG. 8 is an enlarged perspective view as indicated by arrow 8 in FIG. 7, of a portion of the fourth embodiment showing various components thereof.

Figure 9:
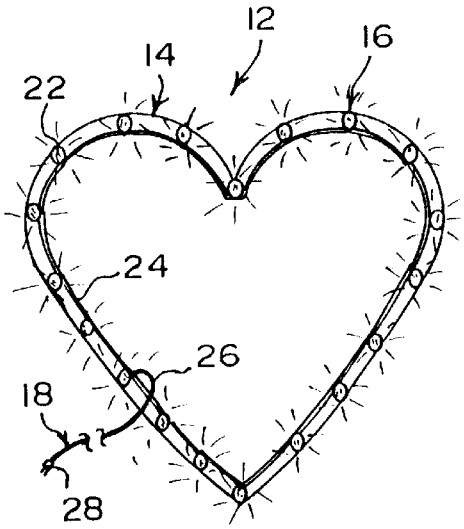

FIG. 9 is a front elevational view of a fifth embodiment of the instant invention.

Figure 10:
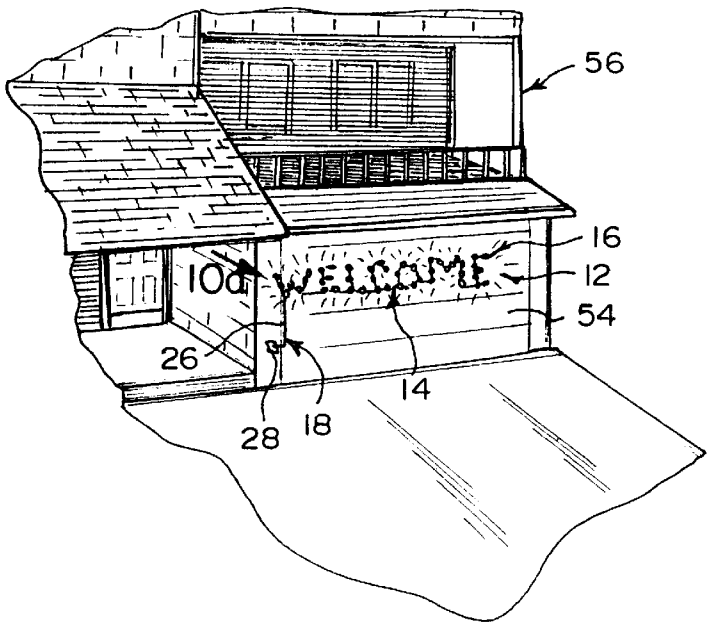

FIG. 10 is a perspective view of a sixth embodiment of the instant invention installed onto a house.

Figure 10A:
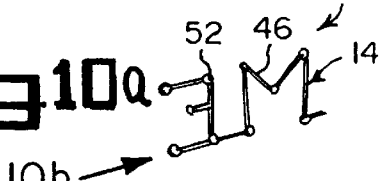

FIG. 10*a* is an enlarged rear perspective view of a portion of the sixth embodiment taken in the direction of arrow 10*a* in FIG. 10.

Figure 10B:
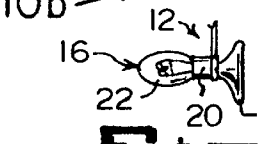

FIG. 10*b* is a further enlarged side view taken in the direction of arrow 10*b* in FIG. 10*a,* showing the suction cup attachment in greater detail.

Figure 11:
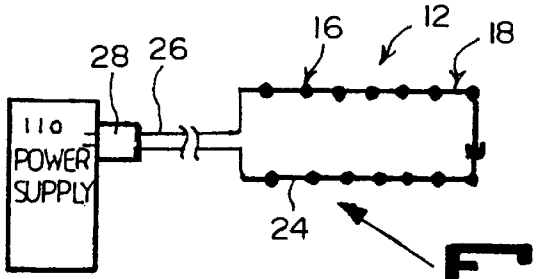

FIG. 11 is a schematic diagram of a typical electrical system thereof.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 11 illustrate a holiday helper lighting system 12 comprising a support frame 14. A plurality of illuminating units 16 are carried on the support frame 14 in spaced apart relationships. An assembly 18 integral with the support frame 14, is for carrying an electrical current to the illuminating units 16, so that the illuminating units 16 will provide light therefrom.

Each illuminating unit 16 includes a light socket 20 mounted on the support frame 14 and a light bulb 22 carried in the light socket 20. The electrical current carrying assembly 18 consists of a plurality of wires 24, electrically connected between the illuminating units 16. A power cord 26 has a first end electrically connected to all of the wires 24. A plug 28 is electrically connected to a second end of the power cord 26, so that the plug 28 can be inserted into an outlet to receive electricity therefrom.

The support frame 14, as shown in FIGS. 1 through 8, is a flexible net 30 having a grid pattern which can fit over an object. The flexible net 30 in FIGS. 1 to 4, is a cone shaped member 32 to fit over a tree 34. The flexible net 30 in FIGS. 5 to 5*b,* is a circular shaped member 36 to bend over a tree 34. In FIG. 6, the flexible net 30 is a rectangular shaped member 38 to wrap about a bush 40. In FIGS. 7 and 8, the flexible net 30 is a dome shaped member 42 to fit over a pumpkin 44.

In FIG. 9, the support frame 14 is a heart shaped member 46 that can be mounted upon a flat vertical object. In FIGS.

10 to 10*b,* the support frame 14 is a plurality of interconnecting letter shaped members 48, which can spell out at least one word.

The circular shaped member 36 includes a plurality of clips 48 to retain the circular shaped member 36 to the tree 34. The rectangular shaped member 38 also includes a plurality of clips 48, to retain the rectangular shaped member 38 to the bush 40.

As best seen in FIG. 8, the dome shaped member 42 contains spring segments 50 to retain the dome shape 42 to the pumpkin 44. The interconnecting letter shaped members 46, as best seen in FIG. 10*b,* include a plurality of suction cup attachments 52 to be retained to a flat vertical object 54, such as an outside wall of a building 56, shown in FIG. 10.

OPERATION OF THE INVENTION

To use the holiday helper lighting system 12, the following steps should be taken:

1. Place the support frame 14, being the flexible net 30 and the cone shaped member 32, as shown in FIGS. 1 through 4, directly over the tree 34.

2. Insert the plug 28 into the outlet.

3. Bend the support frame 14, being the flexible net 30 and the circular shaped member 36, as shown in FIGS. 5 to 5*b* over the tree 34.

4. Attach the clips 48 to the tree branches.

5. Insert the plug 28 into the outlet

6. Wrap the support frame 14, being the flexible net 30 and the rectangular shaped member 38, as shown in FIG. 6, about the bush 40.

7. Attach the clips 48 to the bush branches.

8. Insert the plug 28 into the outlet.

9. Put the support frame 14, being the flexible net 30 and the dome shaped member 42, as shown in FIGS. 7 and 8, over the pumpkin 44.

10. Insert the plug 28 into the outlet.

11. Mount the support frame 14, being the heart shaped member 46, as shown in FIG. 9, upon the flat vertical object.

12. Insert the plug 28 into the outlet.

13. Place the support frame 14, being the interconnecting letter shaped members 48, as shown in FIGS. 10 to 10*b,* up against the outside wall 54 of the building 56.

14. Press all of the suction cup attachments 52 to the outside wall 54.

15. Insert the plug 28 into the outlet.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A holiday helper lighting system comprising:

a) a support frame comprising a preshaped net in a grid pattern adapted to fit over a selected vertical member, said net being sufficiently flexible to permit said net to be bent to conform to the shape of said vertical member after said support frame is placed on said vertical member;

b) a plurality of illuminating units carried on said support frame in spaced apart relationships;

c) means integral with said support frame comprising electric wires concealed within said net and a power cord electrically connected to all of said wires, for carrying an electrical current to said illuminating units, so that said illuminating units will provide light therefrom; and d) clips mounted on said net for connecting said net to various points on said vertical member.

2. A holiday helper light system as recited in claim 1, wherein each said illuminating unit includes:

a) a light socket mounted on said support frame; and b) a light bulb carried in said light socket.

3. A holiday helper light system as recited in claim 2 wherein said vertical member is a tree.

4. A holiday helper light system as recited in claim 2 wherein said vertical member is a bush.

* * * * *